US006860372B2

(12) United States Patent
Hasebe

(10) Patent No.: US 6,860,372 B2
(45) Date of Patent: Mar. 1, 2005

(54) HANDLE ATTACHMENT STRUCTURE FOR BAG

(75) Inventor: Mamoru Hasebe, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/669,208

(22) Filed: Sep. 25, 2003

(65) Prior Publication Data

US 2004/0074726 A1 Apr. 22, 2004

(30) Foreign Application Priority Data

Sep. 30, 2002 (JP) ..... P2002-286187

(51) Int. Cl.[7] ..... A45C 13/00

(52) U.S. Cl. ..... 190/115; 16/114.1; 16/408; 16/409

(58) Field of Search ..... 190/115; 16/114.1, 16/408, 409, 410

(56) References Cited

U.S. PATENT DOCUMENTS 2,254,506 A * 9/1941 Wheary, Jr. ..... 16/409
2,652,908 A * 9/1953 Fuller ..... 16/408
2,896,755 A * 7/1959 Levine ..... 190/115
4,276,676 A * 7/1981 Stolarz ..... 16/409

FOREIGN PATENT DOCUMENTS

JP 1-31063 Y2 9/1989
JP 2-86318 U 7/1990
JP 8-205919 A 8/1996

* cited by examiner

*Primary Examiner*—Tri M. Mai
(74) *Attorney, Agent, or Firm*—Smith Patent Office

(57) ABSTRACT

A handle attachment structure for a bag includes: a bag body; a handle having a through hole in each of ends thereof; an attachment fixed to the bag body while accommodating the end of the handle in a recess formed therein, the attachment including therein a stopped spindle hole and a through spindle hole aligned to each other across the recess, and a coming-out prevention hole crossing the through spindle hole; a handle spindle fixed in the stopped spindle hole and the through spindle hole while passing through the through hole in the handle; and a coming-out prevention spindle fixed in the coming-out prevention hole while crossing the through spindle hole.

2 Claims, 2 Drawing Sheets

HANDLE ATTACHMENT STRUCTURE FOR BAG

BACKGROUND OF THE INVENTION

1. Field of the Invention

The present invention relates to a handle attachment structure for a bag, such as a briefcase and a suitcase.

Priority is claimed on Japanese Patent Application No. 2002-286187, filed Sep. 30, 2002, the content of which is incorporated herein by reference.

2. Description of Related Art

In general, a handle for a bag, which is formed in a substantially U-shape, is rotatably supported by attachments for attaching the handle to a bag body in such a manner that each of the ends of the handle is held by each of the attachments using a handle spindle.

In a general handle attachment structure for a bag shown, for example, in FIG. 3, a through hole 11 having a predetermined diameter is formed in an end 10 of a handle 1, and on the other hand, spindle holes 3 into which a handle spindle 4 is inserted are formed in an attachment 2. The spindle holes 3 is bored from one side of the attachment 2 so as to cross over an engagement recess 20 of the attachment 2, into which the end 10 is to be inserted. In an assembling process for making the handle 1 to be rotatably supported, the through hole 11 and the spindle holes 3 are aligned to each other in the engagement recess 20, and then the handle spindle 4 is inserted from an insertion aperture 31 so as to have an interference fit with the spindle holes 3 by, for example, hammering.

In this case, the inner surfaces of the spindle holes 3 and the outer surface of the handle spindle 4 are precision finished in order to ensure friction therebetween due to insertion and to prevent the handle spindle 4 from coming off the spindle holes 3. When it is necessary, the handle spindle 4 is provided with knurling on the surface near the proximal end thereof.

Alternatively, in some cases, the spindle holes 3 and the handle spindle 4 are provided with screw surfaces thereon, and the handle spindle 4 is screwed into the spindle holes 3.

Many other proposals have been made with regard to handle attachment structures in which handle spindles are used. An example is disclosed in Japanese Examined Utility Model Application, Second Publication No. Hei 01-31063 (Reference 1), in which a reinforcing frame having an elastic piece of metal is provided in order to strengthen a portion for attachment, and the elastic piece prevents a handle spindle from coming off. Another example is disclosed in Japanese Unexamined Utility Model Application, First Publication No. Hei 02-86318 (Reference 2), in which separate attachments are provided, and an end of handle, through which a handle spindle is inserted, is held between the attachments so that the handle is fixed to a bag body. A further example is disclosed in Japanese Unexamined Patent Application, First Publication No. Hei 08-205919 (Reference 3), in which separate attachments including a fixed supporting piece and a movable supporting piece are provided, and a handle spindle having a spring thereon is inserted from the movable supporting piece side so that the movable supporting piece is biased toward an end of a handle, and so that the handle is held in a standing state.

In the conventional handle attachment structure shown in FIG. 3, because the handle spindle and the spindle holes must be precision finished, the manufacturing cost is increased, and reliability may be degraded due to poor assembly in the assembling process and due to variations of accuracy in finishing.

Moreover, the above handle attachment structure also has a problem in terms of strength during use. More specifically, because the handle spindle supports the weight of the bag body and vibrations during use are applied thereto, the handle spindle tends to loosen in the spindle holes due to vibrations and impacts, and, in the worst case scenario the handle spindle may come out of the spindle holes, and the handle attachment structure may be broken, which would require time consuming repair.

In the attachment structures disclosed in References 1 to 3, problems are encountered in that the structures are relatively complex. More specifically, a reinforcing element may be required to ensure strength of a portion for attaching the handle, or manufacturing cost is relatively high because many elements are included and many assembling steps are required due to the separate attachments. Moreover, a problem may be encountered in strength during use as mentioned above.

SUMMARY OF THE INVENTION

The present invention was conceived in view of the above circumstances. An object of the present invention is to provide a handle attachment structure which is simple in structure, which does not require precision machining, which can be easily and reliably assembled, and which will not have problems of loosening and coming off during use due to vibrations and impacts.

In order to achieve the above object, the present invention provides a handle attachment structure for a bag including: a bag body; a handle having a through hole in each of ends thereof; an attachment fixed to the bag body while accommodating the end of the handle in a recess formed therein, the attachment including therein a stopped spindle hole and a through spindle hole aligned to each other across the recess, and a coming-out prevention hole crossing the through spindle hole; a handle spindle fixed in the stopped spindle hole and the through spindle hole while passing through the through hole formed in the handle; and a coming-out prevention spindle fixed in the coming-out prevention hole while crossing the through spindle hole.

In the handle attachment structure, the attachment may further include a screw hole into which a screw element for fixing the attachment to the bag body is screwed, and the screw hole may preferably be aligned with the coming-out prevention hole.

According to the above configuration, the handle attachment structure is simple in structure, does not require precision machining, and can be easily and reliably assembled. In addition, the handle spindle will not come out of the spindle holes even when the handle spindle is loosened in the spindle holes during use due to vibrations and impacts, and thus the strength and reliability of the handle attachment structure are enhanced.

DETAILED DESCRIPTION OF THE INVENTION

Preferred embodiments of the present invention will be explained below with reference to FIGS. 1 and 2.

Figure 1:
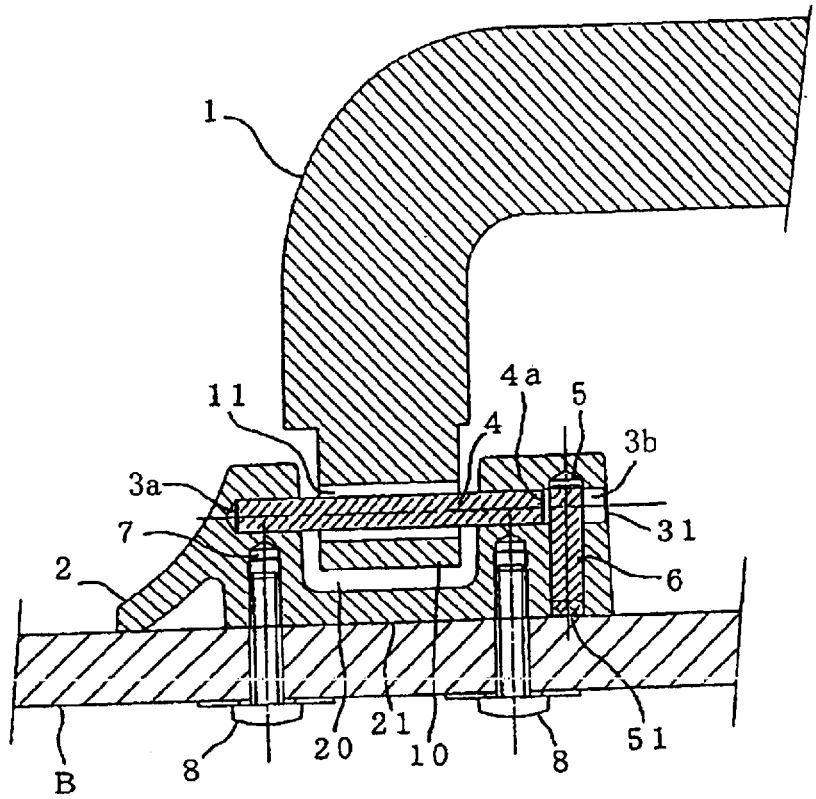
FIG. 1 is a cross-sectional view showing the main portion of an embodiment of the present invention.

FIG. 1 shows an embodiment of the present invention. As in the case of a conventional handle, a handle 1 includes a through hole 11 formed therein in advance near an end 10 thereof.

An attachment 2 is provided therein with a stopped spindle hole 3*a* and a through spindle hole 3*b* being aligned to each other into which a handle spindle 4 is to be inserted. The stopped spindle hole 3*a* and the through spindle hole 3*b* are disposed across an engagement recess 20 formed in the attachment 2, in which the end 10 is to be fitted. The outside end (i.e., opposite the recess 20) of the through spindle hole 3*b* is designated as an insertion aperture 31. The stopped spindle hole 3*a* and the through spindle hole 3*b* are formed by drilling using, for example, a drilling machine. The inside surfaces of the spindle holes 3*a* and 3*b* require just simple finishing, not precision finishing.

In addition, a coming-out prevention hole 5 extending from a bottom 21 of the attachment 2 is formed in the attachment 2 near the insertion aperture 31 of the through spindle hole 3*b* so as to perpendicularly intersect the through spindle hole 3*b*.

The coming-out prevention hole 5 is provided with an insertion aperture 51 through which a coming-out prevention spindle 6 is to be inserted. The length of the coming-out prevention spindle 6 is preferably determined so that the coming-out prevention spindle 6 extends from the insertion aperture 51 and across the through spindle hole 3*b*, i.e., the length is substantially the same as the depth of the coming-out prevention hole 5.

With regard to a fit between the coming-out prevention hole 5 and the coming-out prevention spindle 6, the coming-out prevention spindle 6 may be in a loose fit, or the coming-out prevention spindle 6 may be appropriately fitted in the coming-out prevention hole 5.

Because the coming-out prevention hole 5 and the coming-out prevention spindle 6 are provided, the length of the handle spindle 4 which is to be inserted into the spindle holes 3*a* and 3*b* is consequently determined.

More specifically, the length of the handle spindle 4 is determined such that a rear end 4*a* of the handle spindle 4 does not overlap with the coming-out prevention hole when the handle spindle 4 is fitted in the spindle holes 3*a* and 3*b*.

Next, a process for attaching the handle 1 to a bag body B will be explained below in accordance with a sequence.

First of all, the end 10 of the handle 1 is disposed in the engagement recess 20 of the attachment 2 while aligning the through hole 11 of the handle 1 and the spindle holes 3*a* and 3*b*, and the handle spindle 4 is inserted through the insertion aperture 31 of the through spindle hole 3*b*. The handle spindle 4 is pushed into the spindle holes 3*a* and 3*b* until the rear end 4*a* thereof passes over the coming-out prevention hole 5.

Next, the coming-out prevention spindle 6 is inserted into the coming-out prevention hole 5 through the insertion aperture 51. At this point, the handle 1 is rotatably supported by the attachment 2.

Finally, attachment screws 8 are screwed into screw holes 7, from inside the bag body B, for completing the process for attachment.

The handle spindle 4 is fitted in the spindle holes 3*a* and 3*b* cannot move backward due to the coming-out prevention spindle 6 fitted in the coming-out prevention hole 5; therefore, the handle spindle 4 will not come out of even when impacts are applied thereto during use.

Figure 2:
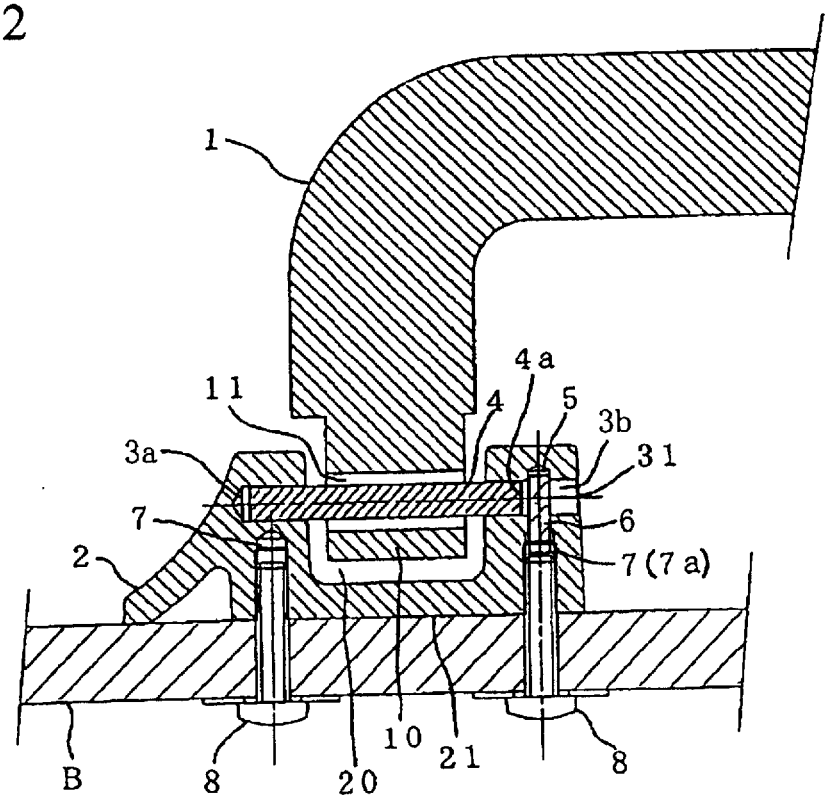
FIG. 2 is a cross-sectional view showing the main portion of another embodiment of the present invention.
Figure 3:
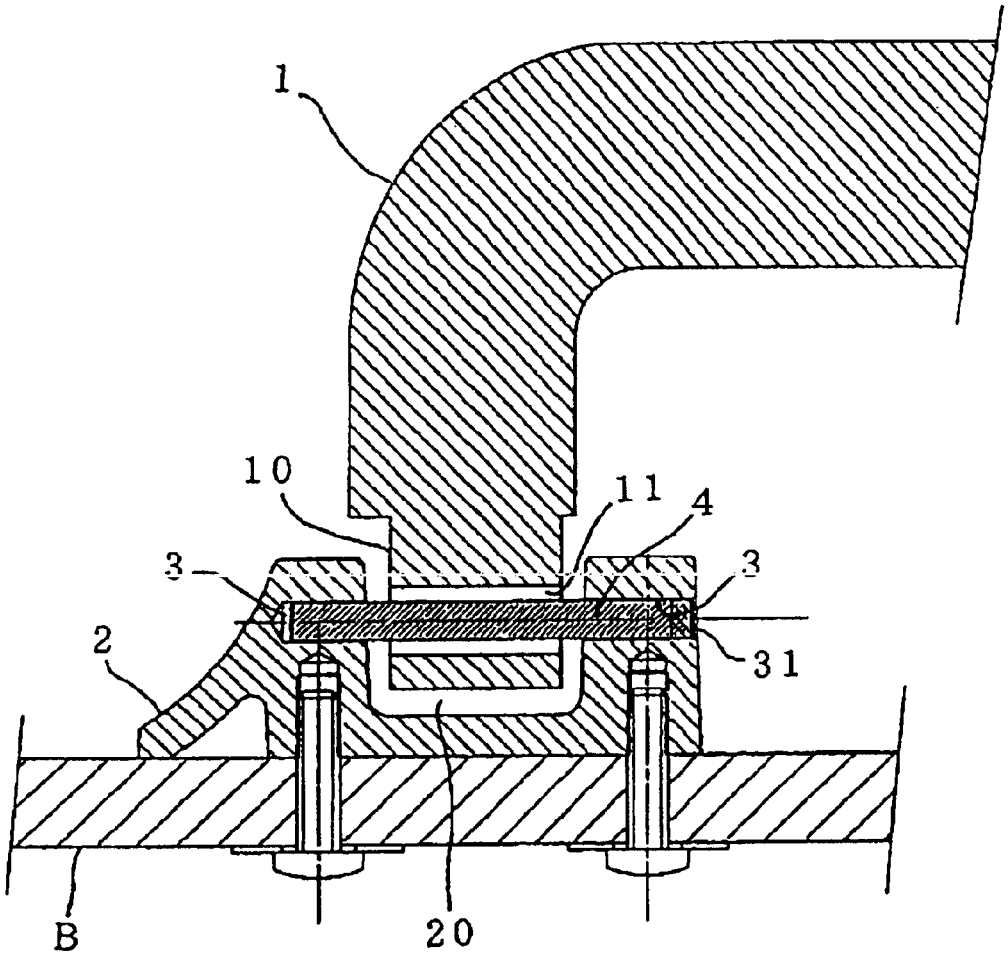
FIG. 3 is a cross-sectional view showing the main portion of an example of a conventional handle attachment structure.

FIG. 2 shows another embodiment of the present invention, in which the coming-out prevention hole 5 is formed continuously with one of the screw holes 7 formed in the bottom portion of the attachment 2.

In the attachment 2, the through spindle hole 3*b*, into which the handle spindle 4 is inserted, is formed so as to cross the axis of one of the screw holes 7 for fixing the attachment 2 to the bag body B. The coming-out prevention hole 5 is formed back of one of the screw holes 7 (7*a*) which is formed near the insertion aperture 31.

As shown in FIG. 2, the coming-out prevention hole 5, into which the coming-out prevention spindle 6 having a diameter matching the diameter of the coming-out prevention hole 5, is formed so as to perpendicularly intersect the through spindle hole 3*b*.

During the process for attaching the attachment 2 to the bag body B, the coming-out prevention spindle 6 is inserted forward by screwing the attachment screw 8; therefore, the length of the coming-out prevention spindle 6 is determined by taking into account the length of the attachment screw 8.

The process for attaching the handle 1 to the bag body B is substantially the same as in the previous embodiment. Because coming off of the coming-out prevention spindle 6 is prevented by screwing the attachment screw 8, preferable reliability can be obtained.

Advantageous Effects Obtainable by the Invention

As explained above, the present invention provides the handle attachment structure for a bag in which the handle is rotatably attached to the bag body using the handle spindle passing through the through hole formed at the end of the handle. The attachment fixed to the bag body accommodates the end of the handle in the recess formed therein. The attachment includes therein the stopped spindle hole and the through spindle hole aligned to each other across the recess, and the coming-out prevention hole crossing the through spindle hole. The coming-out prevention spindle is inserted into the coming-out prevention hole after inserting the handle spindle into the spindle holes so as to perpendicularly intersect the through spindle hole. Accordingly, the handle attachment structure is simple in structure, does not require precision machining, and can be easily and reliably assembled. In addition, the handle spindle will not come out of the spindle holes even when the handle spindle is loosened in the spindle holes during use due to vibrations and impacts, and thus the reliability of the handle attachment structure are enhanced.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A handle attachment structure for a bag comprising:

a bag body;

a handle having a through hole in each of ends thereof;

an attachment fixed to the bag body while accommodating the end of the handle in a recess formed therein, the attachment including therein a stopped spindle hole and a through spindle hole aligned to each other across the recess, and a coming-out prevention hole crossing the through spindle hole;

a handle spindle fixed in the stopped spindle hole and the through spindle hole while passing through the through hole formed in the handle; and a coming-out prevention spindle fixed in the coming-out prevention hole while crossing the through spindle hole.

2. A handle attachment structure for a bag according to claim 1, wherein the attachment further includes a screw hole into which a screw element for fixing the attachment to the bag body is screwed, the screw hole being aligned with the coming-out prevention hole.

* * * * *